US008146906B2

(12) United States Patent
Sugihara

(10) Patent No.: US 8,146,906 B2
(45) Date of Patent: Apr. 3, 2012

(54) SHEET PROCESSING APPARATUS

(75) Inventor: Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 140 days.

(21) Appl. No.: 12/720,884

(22) Filed: Mar. 10, 2010

(65) Prior Publication Data

US 2010/0252983 A1 Oct. 7, 2010

(30) Foreign Application Priority Data

Apr. 1, 2009 (JP) ..... 2009-089568

(51) Int. Cl.
*B65H 37/04* (2006.01)

(52) U.S. Cl. ..... 270/52.18; 270/52.26; 270/52.29; 270/58.08

(58) Field of Classification Search ..... 270/52.18, 270/58.08, 52.26, 52.29
See application file for complete search history.

(56) References Cited

U.S. PATENT DOCUMENTS

| | | | | |
|---|---|---|---|---|
| 6,554,267 | B2 * | 4/2003 | Trovinger | 270/52.18 |
| 6,578,838 | B2 * | 6/2003 | Trovinger et al. | 270/52.18 |
| 6,929,256 | B2 * | 8/2005 | Kawatsu et al. | 270/37 |
| 6,997,450 | B2 * | 2/2006 | Trovinger | 270/52.26 |
| 7,178,799 | B2 * | 2/2007 | Wakabayashi et al. | 270/39.06 |
| 7,637,489 | B2 * | 12/2009 | Brunner et al. | 270/52.18 |
| 7,660,556 | B2 * | 2/2010 | Saitsu et al. | 399/407 |
| 2002/0140153 | A1 | 10/2002 | Trovinger et al. | |
| 2003/0161704 | A1 | 8/2003 | Trovinger | |
| 2006/0153612 | A1 | 7/2006 | Saitsu et al. | |

* cited by examiner

*Primary Examiner* — Patrick Mackey
(74) *Attorney, Agent, or Firm* — Drinker Biddle & Reath LLP

(57) ABSTRACT

A sheet processing apparatus equipped with a saddle stitch stapler is provided with: a driver unit (1) configured to drive a staple; a clincher unit (2) configured to clinch the staple driven by the driver unit (1); a saddle portion (3) integrated with the clincher unit (2); and a guide portion (6) configured to guide the clincher unit (2) toward a predetermined position of the driver unit (1), when a center portion (11) of a bundle of sheets (10) is clamped between the clincher unit (2) and a staple striking portion (21) of the driver unit (1) after the center portion (11) of the bundle of sheets (10) is placed on the saddle portion (3).

3 Claims, 4 Drawing Sheets

SHEET PROCESSING APPARATUS

FIELD OF THE INVENTION

The present invention relates to a sheet processing apparatus equipped with a saddle stitch stapler.

BACKGROUND ART

Disclosed in US2006/0153612A1 is a conventional sheet processing apparatus equipped with a saddle stitch stapler, in which sheets discharged after a completion of operations required in an image forming apparatus are subjected to a booklet folding process by means of a booklet folding apparatus, booklet-folded sheets are placed sequentially on a saddle-shaped sheet stacking portion, positions of the fold lines of sheets constituting a bundle of sheets are aligned, staples are driven at a center portion of the aligned fold line to perform stapling by means of a stapling unit having a two-divided structure including a staple receiving mechanism and a driving mechanism, edge of the bundle of sheets is cut, and then the bundle of sheets is discharged.

However, in the above-mentioned apparatus, a saddle-shaped sheet stacking portion referred to as a saddle, a driver for driving staples and a clincher for bending staples driven into a bundle of sheets by the driver are required to be accurately positioned at a predetermined position. Conventionally, the bundle of sheets folded at the center portion thereof is aligned on the saddle, conveyed between the driver and the clincher, and then stapled. For this reason, the folding position of the bundle of sheets is not aligned with position of stapling, or it takes time to perform the positioning adjustment for the alignment.

SUMMARY OF THE INVENTION

One or more embodiments of the invention provide a sheet processing apparatus equipped with a saddle stitch stapler, capable of performing positioning so that a folding position of a bundle of sheets is easily and securely aligned with a position of stapling.

In accordance with one or more embodiments of the invention, a sheet processing apparatus equipped with a saddle stitch stapler is provided with: a driver unit (1) configured to drive a staple; a clincher unit (2) configured to clinch the staple driven by the driver unit (1); a saddle portion (3) integrated with the clincher unit (2); and a guide portion (6) configured to guide the clincher unit (2) toward a predetermined position of the driver unit (1), when a center portion (11) of a bundle of sheets (10) is clamped between the clincher unit (2) and a staple striking portion (21) of the driver unit (1) after the center portion (11) of the bundle of sheets (10) is placed on the saddle portion (3).

According to the above structure, the alignment of the positions of the three portions, i.e., the striking portion of the driver unit, the clincher of the clincher unit and the saddle portion, is performed through the use of the configuration in which the saddle portion is integrated with the clincher unit, instead of a configuration in which the three portions are moved independently. Hence, the members to be center-aligned are limited to two members, i.e., the driver unit and the clincher unit, and the guide portion is used to adjust the alignment. It is thus not necessary to finely adjust the movement of the clincher unit, and the alignment is performed automatically using the guide portion. For this reason, the rising movement of the clincher unit may be controlled roughly to some extent. Consequently, positioning can be performed so that the folding position of the bundle of sheets is aligned with the position of stitching the bundle of sheets with staples easily and securely.

In the above structure, the guide portion (6) may be formed into a V-groove shape at a position aligned with a center (P) of the striking portion (21) of the driver unit (1) so as to guide an apex portion of the saddle portion (3).

According to the above structure, the guide portion is formed into the V-groove shape at the position aligned with the center of the striking portion of the driver of the driver unit so as to be able to guide the apex portion of the saddle portion provided on the above-mentioned clincher unit. Hence, when the driver unit and the clincher unit move to approach each other, the apex portion of the saddle portion is guided along the inclined faces on both sides of the guide portion and positioned automatically. Therefore, the structure can be simplified and the cost can be reduced.

The sheet processing apparatus of the above structure may further includes: a cutout portion (5) formed at an apex portion of the saddle portion (3), wherein a clincher (12) in the clincher unit (2) can protrude in the cutout portion (5), and a sheet guide roller (9) provided on an inclined face of the saddle portion (3) and configured to guide the sheets (10) while keeping the sheets (10) away from an edge of the cutout portion (5) so that the sheets (10) are not in contact with the edge.

According to the above structure, the cutout portion to which the clincher built in the clincher unit can protrude is formed at the apex portion of the saddle portion, and the sheet guide rollers for guiding the sheets while keeping the sheets away from the edges of the cutout portion of the saddle portion so that the sheets do not make contact with the edges are provided on the inclined faces on both sides of the above-mentioned saddle portion. Hence, when the center portion of the bundle of sheets is clamped between the clincher unit and the staple striking portion of the driver unit, the sheet guide rollers keep the sheets slightly away from the above-mentioned edges so that the sheets do not make contact with the above-mentioned edges, thereby securely preventing the bundle of sheets from being damaged.

Moreover, in the above structure, the driver unit (1) and the clincher unit (2) may be relatively movable in a first direction so that the driver unit (1) and the clincher unit (2) are proximate to and remote from each other, the driver unit (1) may include a driver (20) that is movable along a first line (P) extending in the first direction to drive the staple and has a width extending in a second direction which is perpendicular to the first direction, said width in the second direction corresponding to a length of a crown portion of the staple, the staple including said crown portion and two leg portions bent from both ends of the crown portion, the guide portion (6) may be formed within the driver unit (1) and defined by two inclined surfaces (8*a*, 8*b*), a crossing line defined by intersecting said two inclined surfaces (8*a*, 8*b*) to each other may extend in the second direction, and said crossing line may intersect with said first line.

Other aspects and advantages of the invention will be apparent from the following description, the drawings and the claims.

DETAILED DESCRIPTION OF THE EXEMPLARY EMBODIMENTS

Figure 1:
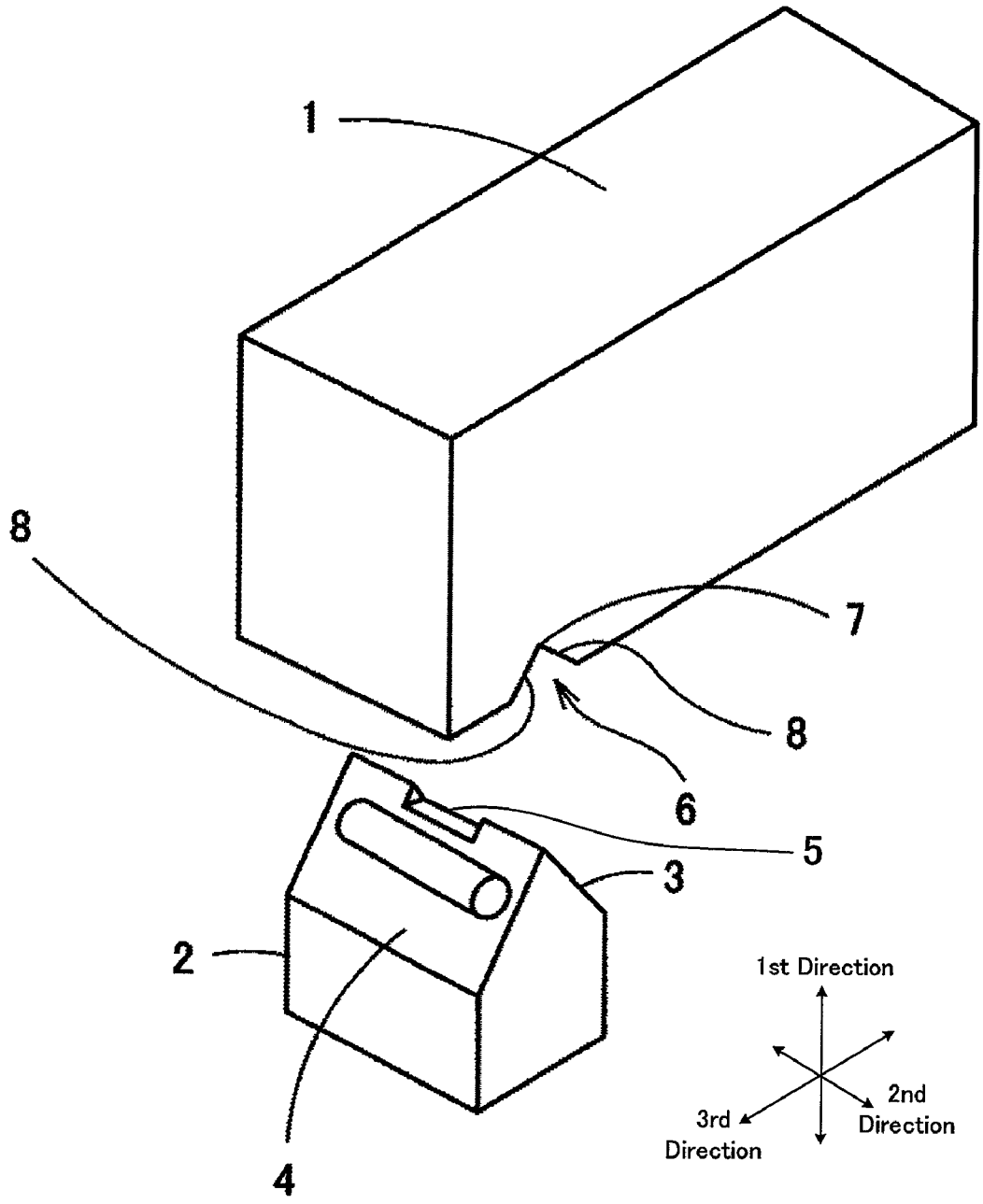
FIG. 1 is a perspective outline view showing a sheet processing apparatus.

FIG. 1 shows a sheet processing apparatus equipped with a saddle stitch stapler according to an exemplary embodiment of the invention. Reference numeral 1 denotes a driver unit, and reference numeral 2 denotes a clincher unit.

The driver unit 1 includes a striking portion 21 for slidably guiding a driver 20, a magazine portion (not shown) for accommodating staples, a feeder unit (not shown) for feeding the staples from the magazine portion to the striking portion 21, a striking drive unit (not shown) for driving the driver 20 downward (in a first direction, toward the clincher unit) and for driving the staples fed to the striking portion, etc. Further, the staple driven by the driver 20 has a crown portion extending in a second direction and two leg portions bent from both ends of the crown portion.

The clincher unit 2 includes a clincher 12 for receiving and bending legs of the staples driven from the above-mentioned striking portion and integrated at the upper end portion thereof with a saddle portion 3 on which a bundle of sheets 10 bent at the center portion thereof is placed. The saddle portion 3 is configured so as to have two inclined faces 4.

During stitching, the clincher 12 is configured so as to protrude upward (toward the driver unit 1) from an apex portion of the saddle portion 3 and to receive the legs of the staples. Hence, a cutout portion 5 is formed at the apex portion of the saddle portion 3 corresponding to the clincher 12, and the clincher 12 protrudes from the bottom portion of the cutout portion 5.

In addition, the clincher unit 2 is located at a position separated from the driver unit 1 in a standby state. During stapling, the clincher unit 2 rises to a position immediately below the striking portion 21 of the driver unit 1 to clamp the bundle of sheets 10 on the saddle portion 3.

A guide portion 6 is formed in the driver unit 1 which is used to guide the clincher unit 2 to a predetermined position of the driver unit 1 when a center portion of the bundle of sheets 10 is clamped between the clincher unit 2 and the staple striking portion 21 of the driver unit 1 after the center portion of the bundle of sheets 10 to be saddle-stitched is placed on the saddle portion 3.

The guide portion 6 is formed into a V-groove shape opening downward. The bottom portion 7 of the guide portion 6 is provided so as to be aligned with a center P (see FIG. 2) of the striking portion 21 of the driver 20 of the driver unit 1. The guide portion 6 is formed into a shape so that the apex portion of the saddle portion 3 provided on the clincher unit 2 is guided along two inclined guide surfaces 8 (8*a*, 8*b*) to a center (a bottom portion 7) of the guide portion 6.

Sheet guide rollers 9 are rotatably disposed on both sides of the cutout portion 5, that is, on the inclined faces 4 of the saddle portion 3. The sheet guide rollers 9 guide the sheets while keeping the sheets slightly away from the edges of the cutout portion 5 of the saddle portion 3 so that the sheets do not make contact with the edges.

Figure 2:
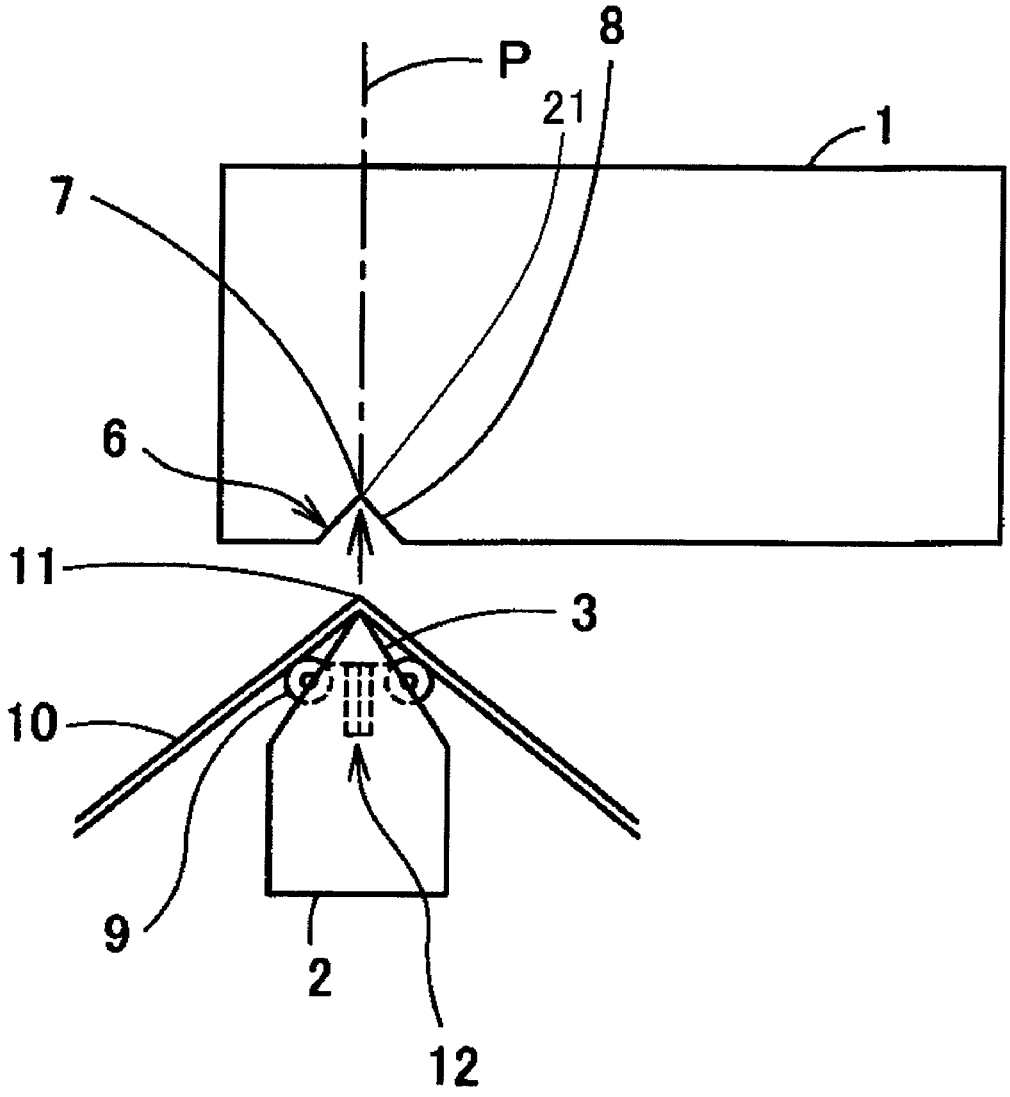
FIG. 2 is an explanatory view showing a state in which a stitching operation is started.
Figure 3:
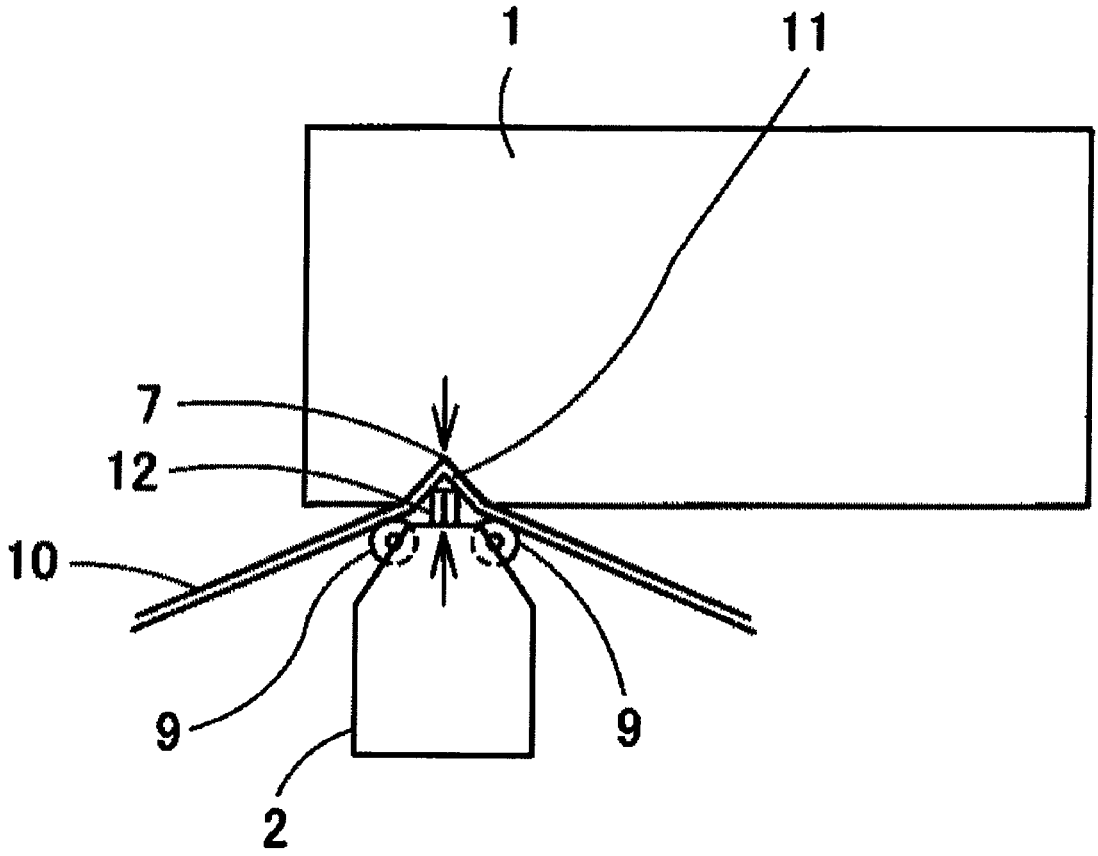
FIG. 3 is an explanatory view showing how the stitching operation is performed.

Operation of the sheet processing apparatus configured as described above will herein be described below. First, as shown in FIG. 2, in a state in which the clincher unit 2 is separated from the driver unit 1, the bundle of sheets 10 which is bent at a center portion thereof is placed on the saddle portion 3 of the clincher unit 2 so that a fold line 11 of the bundle of sheets 10 is aligned with the apex portion of the saddle portion 3. When the stapler is then operated to move the clincher unit 2 toward the driver unit 1, the saddle portion 3 of the clincher unit 2 enters the guide portion 6 of the driver unit 1, whereby the apex portion of the saddle portion 3 is guided along the guide faces 8 of the guide portion 6 toward the bottom portion 7 of the guide portion 6. In this state, the bundle of sheets 10 is clamped as shown in FIG. 3. At this time, the striking portion 21 of the driver unit 1, the clincher 12 of the clincher unit 2 and the fold line 11 of the bundle of sheets 10 placed on the saddle portion 3 are center-aligned with one another.

When the clincher unit 2 rises and the saddle portion 3 clamps the bundle of sheets 10, the sheets may make contact with the edges of the cutout portion 5 of the saddle portion 3. However, the sheet guide rollers 9 keep the sheets slightly away from the above-mentioned edges so that the sheets do not make contact with the above-mentioned edges, thereby securely preventing the sheets from being damaged.

When the stapler is operated in this state to perform stapling, the clincher 12 protrudes from the clincher unit 2, the driver 20 is driven to drive the staples into the bundle of sheets 10, and the legs of the staples are bent by the clincher 12. Since the driver 20, the clincher 12 (see FIG. 2) of the clincher unit 2 and the fold line 11 of the bundle of sheets 10 on the saddle portion 3 are aligned with the center P of the driver 20 of the driver unit 1, the staples are driven into the bundle of sheets 10 at the fold line 11 thereof and collide with the clincher 12 accurately. As a result, the staples are bent and the bundle of sheets 10 is stitched properly.

Figure 4:
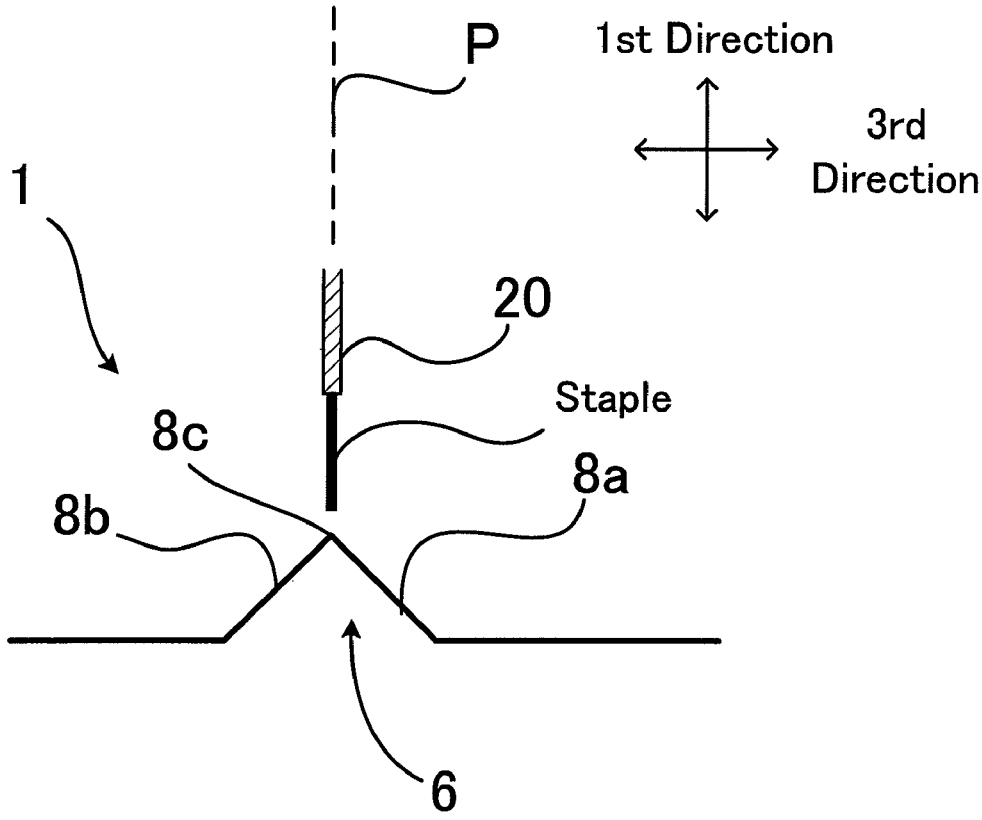
FIG. 4 is a cross-section view showing a relation of a driver and a guide portion seen from a second direction.
Figure 5:
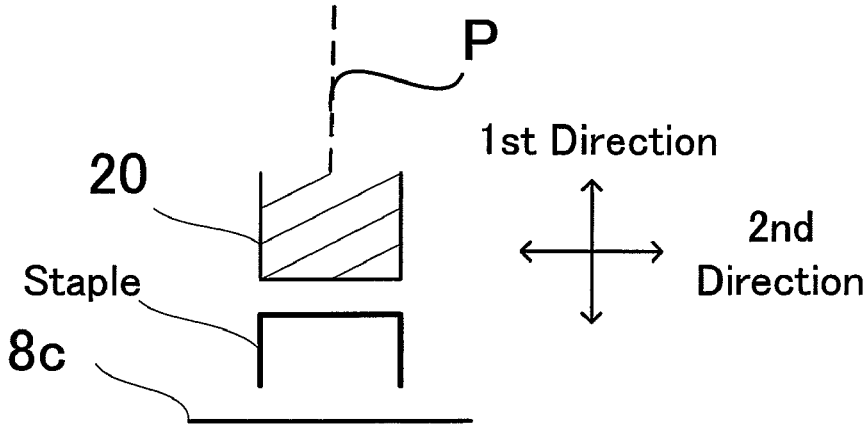
FIG. 5 is a view showing the driver seen from a third direction.

Further, in the above exemplary embodiment, the driver unit 1 is disposed in the upward, and the clincher unit 2 is disposed in the downward. However, a positional relation between the driver unit 1 and the clincher unit 2 is not limited to this. Therefore, in the following explanation, positional relations between respective elements are explained using definitions of directions "first direction", "second direction", and "third direction" as indicated in FIG. 1. FIG. 4 is a cross section view for explaining a positional relation of the driver 20 and the guide portion 6, where the driver 20 and the guide portion 6 are seen from the second direction. FIG. 5 is a view where the driver 20 is seen from the third direction. As described in the above, the driver unit 1 and the clincher unit 2 are relatively movable in the first direction so that the driver unit 1 and the clincher unit 2 are proximate to and remote from each other. The driver 20 is movable along a first line (which is coincident with the above described center P) extending in the first direction to drive the staple and has a width extending in the second direction which is perpendicular to the first direction. The width in the second direction corresponds to a length of the crown portion of the staple in the second direction. The guide portion 6 is defined by the two inclined surfaces 8*a*, 8*b*. A crossing line 8*c* defined by intersecting the two inclined surfaces 8*a*, 8*b* to each other extends in the second direction. The crossing line 8*c* intersects with the first line P. That is, the crossing line 8*c* is located in the same position with the first line P in a third direction which is perpendicular to both the first direction and the second direction.

As described above, the alignment of the positions of the three portions, i.e., the striking portion of the driver unit 1, the clincher 12 of the clincher unit 2 and the saddle portion 3, is performed through the use of the configuration in which the saddle portion 3 is integrated with the clincher unit 2, instead of a configuration in which the three portions are moved independently. Hence, the members to be center-aligned are limited to two members, i.e., the driver unit 1 and the clincher unit 2, and the guide portion 6 is used to adjust the alignment. It is thus not necessary to finely adjust the movement of the clincher unit 2, and the alignment is performed automatically using the guide portion 6. For this reason, the rising movement of the clincher unit 2 may be controlled roughly to some extent. Consequently, positioning can be performed so that the folding position of the bundle of sheets is aligned with the position of stitching the bundle of sheets with staples easily and securely.

A configuration in which the driver unit 1 is moved toward the clincher unit 2 may also be adopted.

Furthermore, another configuration in which the saddle portion 3 is integrated with the driver unit 1 may also be adopted. In this case, the above-mentioned driver unit 1 should only be configured as the clincher unit 2, and the above-mentioned clincher unit 2 should only be configured as the driver unit 1.

DESCRIPTION OF REFERENCE NUMERALS AND SIGNS

1 driver unit
2 clincher unit
3 saddle portion
5 cutout portion
6 guide portion
9 sheet guide roller
10 bundle of sheets
12 clincher

What is claimed is:

1. A sheet processing apparatus equipped with a saddle stitch stapler, the sheet processing apparatus comprising:

a driver unit configured to drive a staple;

a clincher unit configured to clinch the staple driven by the driver unit;

a saddle portion integrated with the clincher unit;

a guide portion configured to guide the clincher unit toward a predetermined position of the driver unit, when a center portion of a bundle of sheets is clamped between the clincher unit and a staple striking portion of the driver unit after the center portion of the bundle of sheets is placed on the saddle portion;

a cutout portion formed at an apex portion of the saddle portion, wherein a clincher in the clincher unit can protrude in the cutout portion, and a sheet guide roller provided on an inclined face of the saddle portion and configured to guide the sheets while keeping the sheets away from an edge of the cutout portion so that the sheets are not in contact with the edge.

2. The sheet processing apparatus according to claim 1, wherein the guide portion is formed into a V-groove shape at a position aligned with a center of the striking portion of the driver unit so as to guide an apex portion of the saddle portion.

3. The sheet processing apparatus according to claim 1, wherein the driver unit and the clincher unit are relatively movable in a first direction so that the driver unit and the clincher unit are proximate to and remote from each other, the driver unit includes a driver that is movable along a first line extending in the first direction to drive the staple and has a width extending in a second direction which is perpendicular to the first direction, said width in the second direction corresponding to a length of a crown portion of the staple, the staple including said crown portion and two leg portions bent from both ends of the crown portion, the guide portion is formed within the driver unit and defined by two inclined surfaces, a crossing line defined by intersecting said two inclined surfaces to each other extends in the second direction, and said crossing line is located in the same position with the first line in a third direction which is perpendicular to both the first direction and the second direction.

* * * * *